US011229264B2

(12) United States Patent
Lauper et al.

(10) Patent No.: US 11,229,264 B2
(45) Date of Patent: Jan. 25, 2022

(54) DECORATIVE PIECE PRODUCED BY SETTING

(71) Applicant: OMEGA SA, Biel/Bienne (CH)

(72) Inventors: Stephane Lauper, Cortaillod (CH); Gregory Kissling, Macolin (CH); Yves Winkler, Schmitten (CH); Alban Dubach, Bienne (CH); Stewes Bourban, Chabrey (CH); Alexandre Netuschill, Le Prevoux (CH); Lionel Blaser, Corcelles (CH)

(73) Assignee: OMEGA SA, Biel/Bienne (CH)

( * ) Notice: Subject to any disclaimer, the term of this patent is extended or adjusted under 35 U.S.C. 154(b) by 0 days.

(21) Appl. No.: 16/901,370

(22) Filed: Jun. 15, 2020

(65) Prior Publication Data

US 2020/0305561 A1 Oct. 1, 2020

Related U.S. Application Data

(60) Division of application No. 14/752,286, filed on Jun. 26, 2015, now abandoned, which is a continuation of (Continued)

(30) Foreign Application Priority Data

Dec. 21, 2012 (EP) ..... 12199279
Apr. 26, 2013 (EP) ..... 13165603

(51) Int. Cl.
*A44C 17/02* (2006.01)
*G04B 45/00* (2006.01)

(Continued)

(52) U.S. Cl.
CPC ..... *A44C 17/02* (2013.01); *A44C 17/04* (2013.01); *G04B 45/00* (2013.01); *G04B 47/042* (2013.01);

(Continued)

(58) Field of Classification Search
CPC ..... A44C 17/02; A44C 17/006; A44C 27/00; A44C 27/003; A44C 17/04; G04B 19/103;

(Continued)

(56) References Cited

U.S. PATENT DOCUMENTS 1,754,964 A * 4/1930 Pancoast ..... B60R 19/285 359/548
3,931,719 A * 1/1976 Schwab ..... A44C 17/04 63/28

(Continued)

FOREIGN PATENT DOCUMENTS

CH 91784 A 9/1986
CH 694 752 7/2005

(Continued)

OTHER PUBLICATIONS

International Search Report dated Feb. 25, 2014 in PCT/EP2013/077495 Filed Dec. 19, 2013.

*Primary Examiner* — Jack W Lavinder
(74) *Attorney, Agent, or Firm* — Oblon, McClelland, Maier & Neustadt, L.L.P.

(57) ABSTRACT

A decorative piece includes a support made of a material having no usable plastic deformation in which at least one hollow is arranged. The hollow is filled with a first material forming a substrate in which at least one housing is arranged. The housing is arranged so that at least one aesthetic element is housable therein. The substrate further includes a gripper elastically deforming to retain the aesthetic element in the housing. The gripper further includes at least one setting element. A method for setting an aesthetic element on a support includes taking a support provided with at least one hollow, taking at least one aesthetic element, filling the hollow with a first material, making a setting hole and a gripper in the first material, and setting the (Continued)

aesthetic element by placing it in the hole and by deforming the gripper so as to retain the aesthetic element.

8 Claims, 6 Drawing Sheets

Related U.S. Application Data application No. 14/653,095, filed as application No. PCT/EP2013/077495 on Dec. 19, 2013, now Pat. No. 10,212,995.

(51) Int. Cl.

| | |
|---|---|
| ***G04B 47/04*** | (2006.01) |
| ***A44C 17/04*** | (2006.01) |
| *A44C 17/00* | (2006.01) |
| *A44C 27/00* | (2006.01) |
| *G04B 19/10* | (2006.01) |

(52) U.S. Cl.
CPC ..... *A44C 17/006* (2013.01); *A44C 27/00* (2013.01); *A44C 27/003* (2013.01); *G04B 19/103* (2013.01); *Y10T 29/24* (2015.01)

(58) Field of Classification Search
CPC .. G04B 39/00; G04B 45/0076; G04B 47/042; Y10T 29/24; Y10T 29/23
USPC ..... 368/285, 294, 295, 296
See application file for complete search history.

(56) References Cited

U.S. PATENT DOCUMENTS

| | | | | |
|---|---|---|---|---|
| 4,796,442 | A * | 1/1989 | Sarcona | A44C 17/0233 29/10 |
| 5,155,990 | A * | 10/1992 | Poll | A44C 11/007 59/80 |
| 5,983,670 | A * | 11/1999 | Noda | A44C 15/007 63/26 |
| 6,491,424 | B1 * | 12/2002 | Tardy | G04B 39/00 368/283 |
| 8,974,113 | B1 * | 3/2015 | Chan | G04B 19/10 368/285 |
| 9,084,457 | B2 * | 7/2015 | Rizzo | A44C 17/02 |
| 10,067,476 | B2 * | 9/2018 | Bonke | G04B 47/042 |
| 2005/0210677 | A1 * | 9/2005 | Yakubovich | A44C 17/005 29/896.41 |
| 2006/0037361 | A1 * | 2/2006 | Johnson | B22D 19/00 63/37 |
| 2011/0103199 | A1 | 5/2011 | Winkler et al. | |
| 2012/0024432 | A1 | 2/2012 | Bain et al. | |
| 2013/0021882 | A1 * | 1/2013 | Grossenbacher | A44C 17/04 368/285 |
| 2014/0345324 | A1 * | 11/2014 | Rizzo | A44C 17/04 63/28 |

FOREIGN PATENT DOCUMENTS

| | | |
|---|---|---|
| EP | 2 138 323 | 12/2009 |
| EP | 2 180 385 | 4/2010 |
| FR | 2 723 520 | 2/1996 |
| GB | 2 079 140 | 1/1982 |

* cited by examiner

DECORATIVE PIECE PRODUCED BY SETTING

CROSS-REFERENCE TO RELATED APPLICATIONS

This application is a divisional of U.S. application Ser. No. 14/752,286 filed Jun. 26, 2015, which is a continuation of U.S. application Ser. No. 14/653,095 filed Jun. 17, 2015, and now U.S. Pat. No. 10,212,995 issued Feb. 26, 2019, which is a National phase application in the United States of International patent application PCT/EP2013/077495 filed Dec. 19, 2013, and which claims priority to European patent application No. 12199279.6 filed Dec. 21, 2012 and European patent application No. 13165603.5 filed Apr. 26, 2013. The benefit of priority is claimed to each of the foregoing, and the entire contents of each of the foregoing are incorporated herein by reference.

The present invention concerns a decorative piece. This decorative piece comprises a support in which at least one aesthetic element is set.

BACKGROUND OF THE INVENTION

There are known, in the prior art, decorative pieces intended to be added to a portable object, such as a watch or piece of jewellery, and consisting in the setting of an aesthetic element on parts of said portable object acting as support.

For this purpose, the part is made of metallic alloy and is machined so that housings appear. During this machining, gripping means taking the form of hooks are made. Generally speaking, these hooks are made integral with the material forming the object that is to say in one-piece with the object. When an aesthetic element, such as a precious stone, has to be set, the latter is placed in a housing and the gripping means are folded down so as to hold said aesthetic element in the housing. This setting method is widely used for setting precious stones in metal supports since the metal has an advantageous capacity for plastic deformation. This capacity is even more advantageous with precious metals such as gold, since these precious metals are ductile and can easily be shaped. Cold plastic deformation of crystalline metals is made possible by the movements of the lattice dislocations present in the crystal lattices. The elastic limit, i.e. the stress beyond which a material starts to deform plastically, of a crystalline alloy depends on its constituent elements and on the thermomechanical history of the alloy. For conventional setting, alloys having relatively low elastic limits are generally selected to facilitate the work of the setter. In addition to a relatively low elastic limit, it is necessary for the alloy to have sufficient elongation before rupture in order to be able to fold down the gripping means without them breaking. As with the elastic limit, this elongation is the consequence both of the elements present in the alloy and of the thermomechanical history thereof. For example, gold alloys used in horology have an elastic limit on the order of 200-400 MPa and a breaking elongation of 20-40%. 1.4435 type stainless steels have an elastic limit of 200-300 MPa and a breaking elongation of 25-45%.

Nevertheless, one drawback of this method is that it is limited to supports made of ductile metals or metal alloys. Now, timepieces are increasingly made of materials with no plastic deformation, which are often hard and/or brittle, such as for example, ceramics, silicon, composites or even intermetallic alloys.

Consequently, it is no longer possible to use the current method for setting aesthetic elements, such as for example, precious stones.

This setting operation is therefore replaced by an adhesive bonding operation. Adhesive bonding has the drawback of not ensuring 100% retention of the stones since, unlike setting, this technique does not involve mechanical retention of the stones. Indeed, as the bonded areas are in most cases exposed to the external environment (humidity, sweat, UV, air pollution, . . . ) the resistance of bonding over the long term is made difficult. Consequently, retention of the stones is not ensured which is unacceptable for high quality products.

SUMMARY OF THE INVENTION

The invention concerns a decorative piece that overcomes the aforementioned drawbacks of the prior art by proposing a decorative piece and its method of manufacture which allow setting of the aesthetic element on a part made of materials which do not have sufficient plastic deformation.

To this end, the invention concerns a decorative piece including a support made of a material having no plastic deformation in which at least one hollow is made, characterized in that said hollow is filled with a first material forming a substrate in which at least one housing is arranged, said at least one housing being arranged so that at least one aesthetic element can be housed therein, said substrate further including at least one gripping means that deforms plastically to hold said at least one aesthetic element in said at least one housing, said gripping means further including at least one setting element.

In a first advantageous embodiment, said at least one setting element takes the form of a stud or a bead.

In a second advantageous embodiment, said at least one hollow includes vertical flanks to improve retention of each aesthetic element in the support.

In a third advantageous embodiment, said at least one hollow includes flanks arranged so that the surface of the hollow increases with the depth of the hollow.

In a fourth advantageous embodiment, said at least one hollow includes flanks arranged so that the surface of the hollow decreases with the depth of the hollow.

In another advantageous embodiment, said at least one hollow includes retaining means extending from one of the walls of the hollow to retain the first material in said hollow.

In another advantageous embodiment, the retaining means take the form of at least one recess.

In another advantageous embodiment, the retaining means take the form of at least one through recess.

In another advantageous embodiment, the retaining means take the form of at least one protuberance.

In another advantageous embodiment, the first material is metallic.

In another advantageous embodiment, the first material is an at least partially amorphous metallic material.

In another advantageous embodiment, the first material is a totally amorphous metallic material.

In a first advantageous embodiment, the first material includes at least one element which is of the precious type, included in the list including gold, platinum, palladium, rhenium, ruthenium, rhodium, silver, iridium or osmium.

In another advantageous embodiment, the distance between the aesthetic element and an edge of the hollow is at least 0.01 mm.

In another advantageous embodiment, the height of the housing is at least equal to the height of the culet of the aesthetic element.

The invention also concerns a method for setting at least one aesthetic element on a support including the steps of:

a) taking a support made of a brittle material with at least one hollow;

b) taking at least one aesthetic element;

c) filling said hollow with a first material;

d) making at least one housing and gripping means in the first material;

e) setting said at least one aesthetic element by placing it in said at least one housing and by deforming the gripping means so as to retain it.

The invention also concerns a method for setting at least one aesthetic element on a support including the steps of:

a) taking a support provided with at least one hollow;

b) taking at least one aesthetic element;

c) filling said hollow with a first at least partially amorphous material;

d) locally heating said first material to at least its vitreous transition temperature;

e) inserting said at least one aesthetic element in the first material, then cooling.

The invention also concerns a method for setting at least one aesthetic element on a support including the steps of:

a) taking a support provided with at least one hollow;

b) taking at least one aesthetic element;

c) filling said hollow with a first at least partially amorphous material;

d) locally heating said at least one aesthetic element to at least the vitreous transition temperature of said first material;

e) inserting said at least one aesthetic element in the first material, then cooling.

In a first advantageous embodiment, the setting step e) consists of plastic deformation of the gripping means.

In a second advantageous embodiment, the setting step e) consists of elastic deformation of the gripping means.

In a third advantageous embodiment, the setting step e) consists of thermal expansion of the support and of the first material in order to set said at least one aesthetic element in said at least one housing.

In another advantageous embodiment, the first material is metallic.

In another advantageous embodiment, the first material is an at least partially amorphous metallic material.

In another advantageous embodiment, the first material is a totally amorphous metallic material.

In a first advantageous embodiment, the first material includes at least one element which is of the precious type, included in the list including gold, platinum, palladium, rhenium, ruthenium, rhodium, silver, iridium or osmium.

In another advantageous embodiment, the filling step c) consists of electroforming deposition of said first material.

In another advantageous embodiment, the filling step c) consists of filling the hollow by casting.

In another advantageous embodiment, the filling step c) consists of filling the hollow by hot forming.

In another advantageous embodiment, the filling step c) consists of filling the hollow by driving a substrate into a metallic element.

In another advantageous embodiment, step c) intended to fill the hollow by driving in consists of heating the support in order to expand it thermally and increasing the dimensions of the hollow then placing the substrate in the hollow and finally cooling to contract the support.

In another advantageous embodiment, the filling step c) consists of filling the hollow by powder densification.

The present invention thus offers the possibility of using a known setting method and therefore of not complicating the method.

Another advantage of this solution is that it makes it possible to set any type of material. Indeed, the principle used is a principle of added material, that is to say a substrate made of deformable material is inserted into a non-plastically deformable material so as to permit setting and give the impression that it is the non-plastically deformable material that is set.

BRIEF DESCRIPTION OF THE DRAWINGS

The objects, advantages and features of the decorative piece and of its method according to the present invention will appear more clearly in the following detailed description of at least one embodiment of the invention, given solely by way of non-limiting example and illustrated by the annexed drawings, in which.

DETAILED DESCRIPTION OF THE INVENTION

In the following description, all those parts of the decorative piece that are well known to those skilled in the art in this technical field will be described only in a simplified manner.

Figure 1:
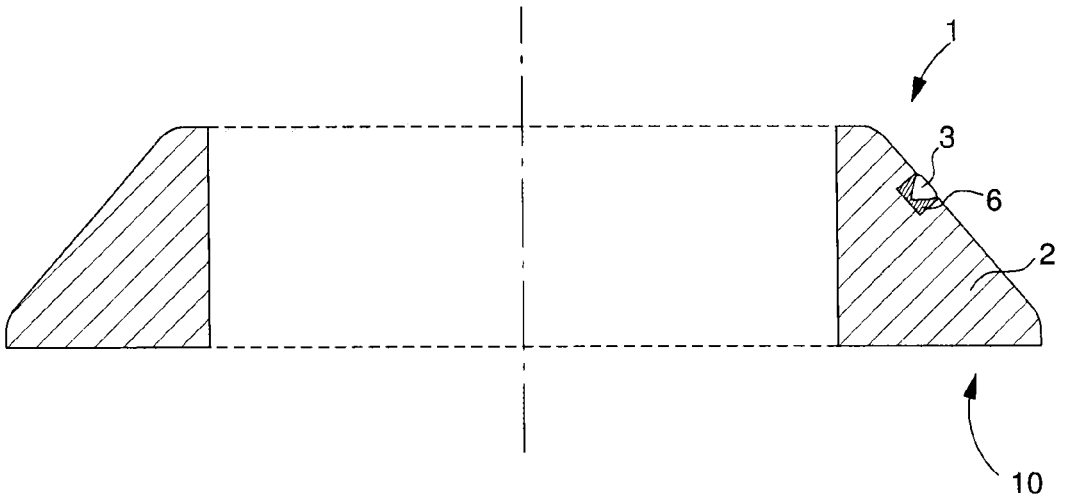
FIGS. 1 and 2 show schematic views of an example decorative piece using the present invention.
Figure 2:
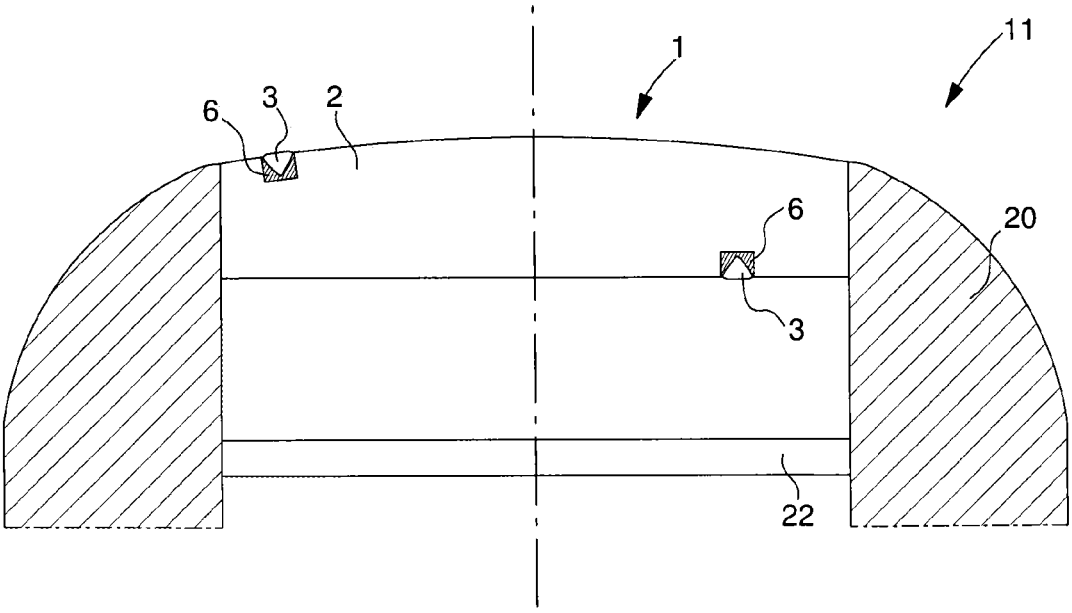

As seen in FIGS. 1 and 2, the present invention is a decorative piece 1. It is formed of a first portion 2 and of a second portion 3. The two portions 2, 3 are arranged to be joined to each other. More specifically, second portion 3 is intended to be set in first portion 2. For example, the first portion may be a support 2 and the second 3 one or more aesthetic elements. This or these aesthetic elements 3 may be precious stones, such as diamonds or rubies, or non-precious stones such as zircons or any other possible aesthetic element.

FIGS. 1 and 2 show example embodiments of the invention. Decorative piece 1 may be, for example, a watch bezel 10 inlaid with symbols as seen in FIG. 1, or a watch crystal 11 as seen in FIG. 2, or a dial 22 or any external part of a watch. In the example of a dial, the latter includes a discoid body forming support 2 in which aesthetic elements 3 are set. This dial may, for example, be made of ceramic material. It will be understood that ceramic is not the only material able to be used. Thus, any material that does not have sufficient plastic deformation, or whose elastic limit is too high to permit setting, may be used such as, for example, sapphire, silicon, glass or even hardened steel. In the case of a crystal made of sapphire, setting said crystal has the advantage of permitting a three-dimensional visual effect, such as an hour circle or logo above the hands. It will be understood that decorative piece 1 may be a pen or a cuff link or a piece of jewellery such as a ring or an earring. The surface of support 2 which will be set may then be flat or curved, i.e. concave or convex.

Figure 4:
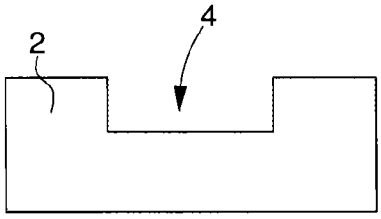

Advantageously according to the invention, this support 2 includes at least one hollow 4, shown in FIG. 4, arranged on said support 2 to permit the setting of at least one aesthetic element 3. Each hollow 4 then takes the form of a motif and has flanks 7 preferably substantially perpendicular to the visible surface. These hollows 4 are employed to permit the use of a substrate 6 for the setting. Indeed, the invention proposes to fill said hollow 4 with a first, more easily plastically deformable material in order to be able to set said at least one aesthetic element 3, which is not possible with a ceramic or silicon support. Thus, in order to fill said hollows 4, it is envisaged in the present invention to use a first material which is metallic.

Figure 3:
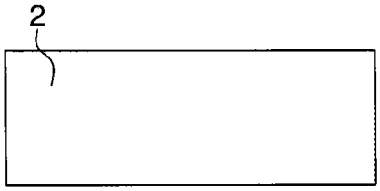
FIGS. 3 to 11 illustrate schematically the steps of the manufacturing method according to an example of the invention.

The first step, seen in FIG. 3, consists in taking a support 2 made of a material that does not deform plastically.

The second step, seen in FIG. 4, thus consists of forming hollow 4 in support 2. This hollow 4 can be produced for example by machining, laser ablation, or even directly during casting of the support or by any other technique.

The third step consists in filling said hollow with a first material. This first material is then used to serve as substrate 6. The third step makes it possible to obtain the support 2 seen in FIG. 6.

A metal or metallic alloy, which may or may not be partially amorphous, is used as first material. The term "partially amorphous" means that for a block of material, the percentage of material of said block having the amorphous state is sufficient for the block itself to have the characteristics specific to amorphous metals and metal alloys. Amorphous materials have the advantage of being easy to shape. Likewise, it may be possible to use a precious metal or one of these alloys to give said decorative piece a noble appearance. Thus, the precious metal or one of these alloys is included in the list comprising gold, platinum, palladium, rhenium, ruthenium, rhodium, silver, iridium or osmium.

One of the methods for filling hollow 4 consists of using electroforming. The principle used to achieve this filling consists, for electrically non-conductive materials, of depositing a first conductive adhesion layer by known techniques such as, for example: physical vapour deposition (PVD), chemical vapour deposition (CVD), electroless deposition or other techniques. For electrically conductive materials, the adhesion layer is not necessarily required. Once the adhesion layer has been deposited, hollows 4 are filled with metal by electroforming. The piece to be marked is then dipped in a bath containing metal ions which are deposited by an electric current on said piece. Hollows 4 are then filled with metal making it possible to produce said marks.

A second method for filling the hollow consists in using a driving in assembly method. This method consists in making a block of metallic alloy whose dimensions and shape are slightly greater than those of hollow 4 and in forcing the block inside said hollow 4. Advantageously, this assembly step may be performed using thermal expansion. For this purpose, support 2 is heated such that, under the effect of heat, it expands thermally. The dimensions of support 2 are increased. This increase in dimensions is likewise applicable to hollow 4. Consequently, the difference between the dimensions of hollow 4 and the dimensions of the block is modified so that the dimensions of hollow 4 become greater than those of the block. It is then easy to insert the block into hollow 4. When support 2 is cooled, it returns to its initial dimensions and the block is confined inside said hollow 4.

Figure 5:
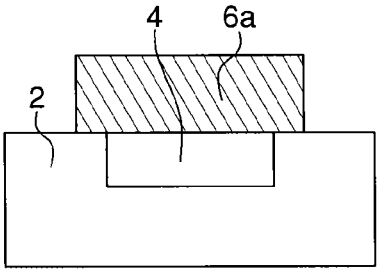
Figure 6:
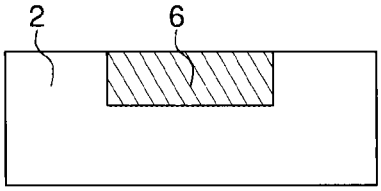

A third method for filling the hollow consists of using hot forming. FIGS. 5 and 6 show, in a simplified manner, the steps of filling hollow 4. Firstly, it is necessary, on the one hand, to make support 2 as seen in FIG. 3 and, on the other hand, to make a preform **6*a* of amorphous metallic alloy. This preform 6*a* can be produced by various techniques, such as, for example, injection in a mould, hot forming above the Tg, stamping from a strip or by machining. Once this preform 6*a* is made, it is placed above support 2, as seen in FIG. 5, on the face where said hollows 4 open in order to fill said hollows by hot forming. The assembly is then heated to a temperature above the vitreous transition temperature Tg, thereby permitting a reduction in the viscosity of the preform, then a pressure is exerted. Once these conditions are combined, the pressure exerted on the viscous preform allows the viscous amorphous metallic alloy to fill hollow 4 as seen in FIG. 6. Then, when hollows 4 are filled as seen in FIG. 6**, the assembly is cooled to preserve the amorphous state of the alloy.

Materials of this type are very suitable because they can thus easily fill the entire volume of hollow 4. After cooling, vertical flanks 7 make it possible to retain the amorphous material by friction. Of course, flanks 7 may be inclined so as to narrow the surface of the horizontal plane at the bottom of hollow 4 or, conversely, to enlarge it. The most advantageous case is that where the surface of the bottom of hollow 4 is the largest since it makes it possible to naturally retain the amorphous metallic alloy in hollow 4. Conversely, when the inclination results in a larger section at the surface of support 2, retention of the amorphous material in hollow 4 is no longer optimal. Another advantage is that this diminishing viscosity results in a reduction in the stress to be applied to fill hollows 4 with the amorphous metallic alloy. For this reason, support 2 made of brittle materials does not risk being broken even though a pressing operation is performed.

Of course, other types of shaping are possible, such as, for example, casting or injection moulding which consists in heating a metallic preform above its melting point and then of casting or injecting the liquid metal thereby obtained into hollow 4 of support 2.

The method of powder densification may also be used and consists in introducing a metallic power into hollow 4 of support 2 and in compacting it by applying energy, such as a furnace, a laser beam, an ion beam or any other means. Once the hollow 4 has been filled, a step of cooling to a temperature below $T_g$ is performed to prevent crystallisation of the alloy and thus to obtain a hollow 4 filled with amorphous or semi-amorphous metal alloy.

Once the hollow has been filled, a fourth preparatory step is performed. This step consists in making the setting housings or holes 8 in which aesthetic elements 3 are placed, and in making the gripping means. This step may either be achieved in a conventional manner, such as machining, milling or piercing, or in a less conventional manner, by hot deformation, or by a combination of the two. The hot deformation method consists of using a tool having the negative geometry of the hole and of the setting element and of applying this tool with a force and at a temperature above the Tg of the amorphous metal, to the amorphous metallic alloy filling hollow 4. It is hence possible to avoid using machining steps which may be difficult depending on the amorphous metallic alloys used.

Figure 8:
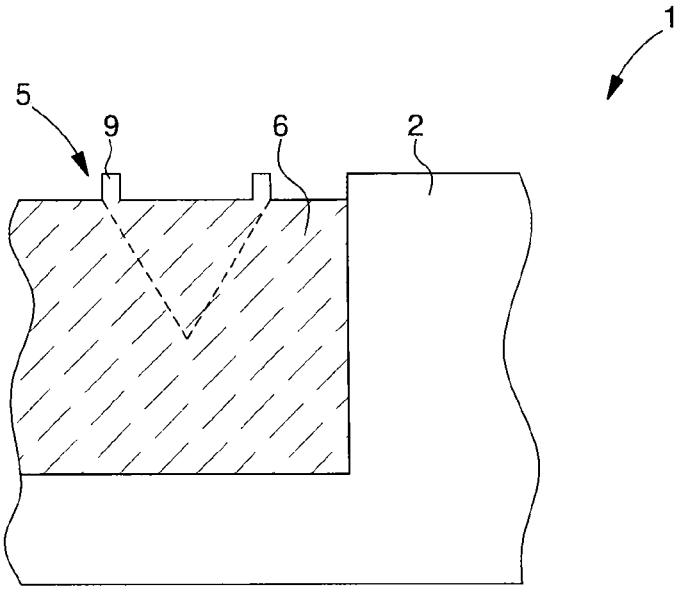
Figure 9:
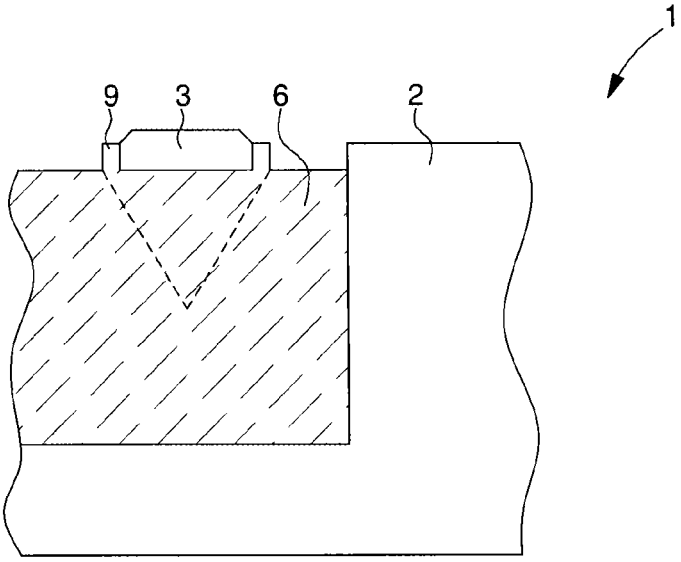
Figure 10:
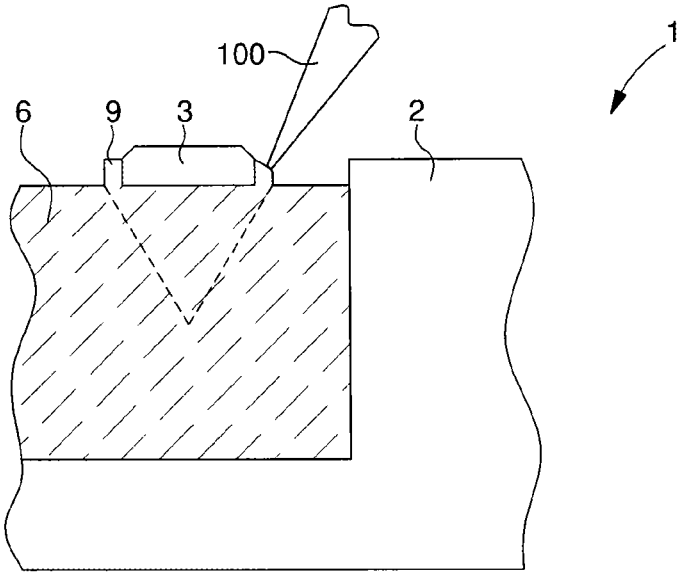
Figure 11:
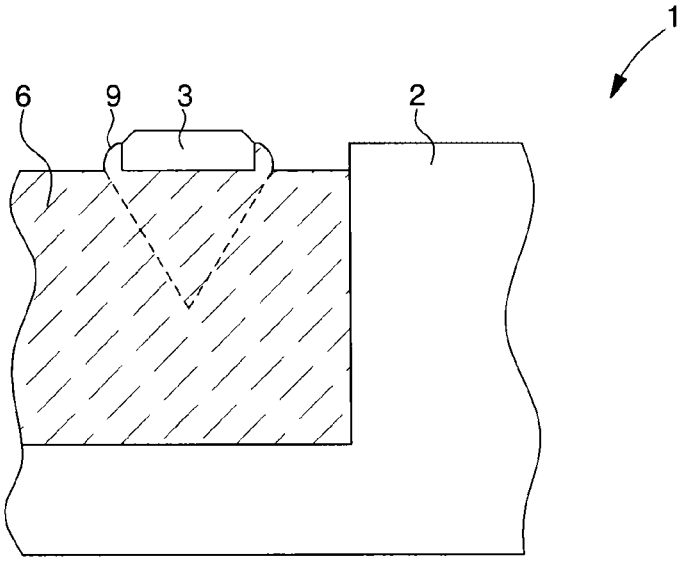
Figure 12:
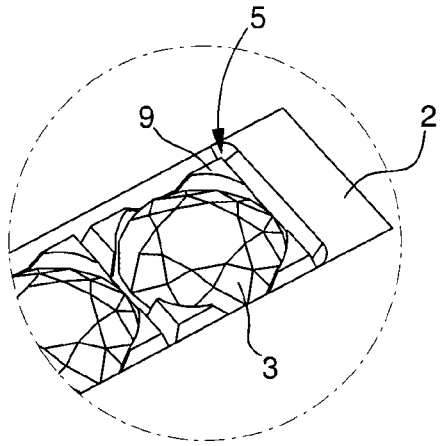
FIGS. 12 and 13 show a top view of aesthetic elements which are set and non-set according to the invention.
Figure 13:
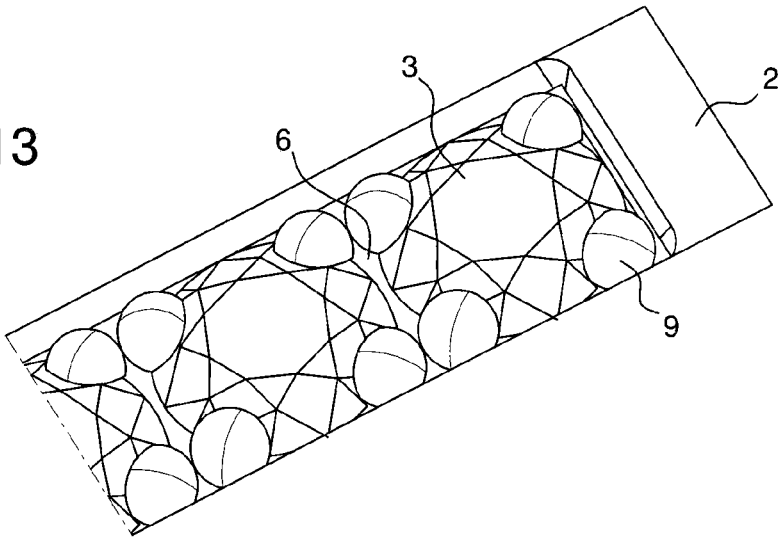

Gripping means 5 take the form of at least one setting element 9. This setting element 9, in the case for example of a bead setting, consists of studs or beads arranged on the periphery of each setting hole 8. These studs 9, seen in FIGS. 8 and 10, are made by machining and are formed before or after piercing of the setting holes 8. In fact, during machining of the holes, some of the material of substrate 6, i.e. the first material, is removed so as to form these setting beads 9. Preferably, in the case of bead setting, there are ideally provided four setting beads 9 in proximity to each setting hole 8 as seen in FIG. 10.

It will be clear, in particular, that other types of setting may be envisaged. Hence, closed setting, baguette setting, rail setting or invisible setting may be envisaged. For example, closed setting consists of a single setting element 9 extending over the periphery of aesthetic element 3. Baguette setting is used to set aesthetic elements 3 cut into a baguette. This setting consists in providing setting elements 9 extending parallel to each side of aesthetic element 3 and which are folded down thereon. With invisible setting, it is provided that setting elements 9 are projecting portions arranged in setting hole 8. These projecting portions cooperate with at least one groove made on said aesthetic element 3 so that setting occurs by inserting aesthetic element 3 in hole 8 until the projecting portions are inserted in said at least one groove.

Preferably, in the case of bead setting, there are ideally provided four setting beads 9 in proximity to each setting hole 8 as seen in FIG. 10.

Figure 15:
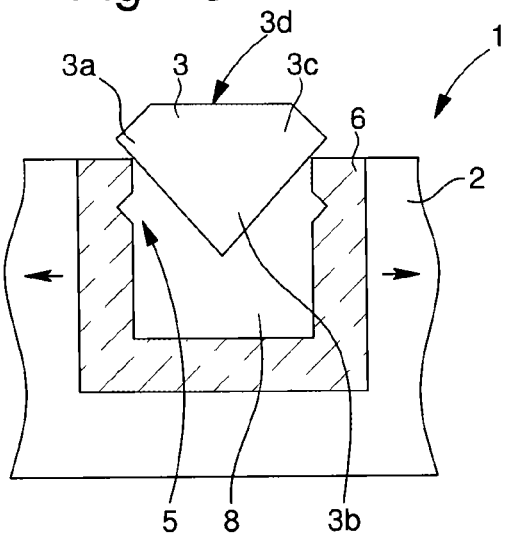
FIGS. 15 and 16 show an alternative of the method according to the invention.

In a particular example embodiment seen in FIG. 10, aesthetic element 3 takes the form of a diamond including a culet 3*b* in which several facets and a crown 3*c* likewise faceted and surmounted by a table 3*d*, are cut, as seen in FIG. 15. Seen from above, the aesthetic element has a substantially circular shape. In order to preserve the illusion of a setting in the material of support 2, it is provided that the width of hollow 4 is ideally equal to that of aesthetic element 3. Preferably, it will be understood that the distance between aesthetic element 3 and the edge of hollow 4 must be at least 0.01 mm so that the visual effect of aesthetic element 3 in support 2 is optimal, i.e. to give the impression that aesthetic element 3 remains embedded in support 2 made of ceramic and not in a metal. The maximum distance between aesthetic element 3 and the edge of hollow 4 will depend on the dimensions and shapes of aesthetic elements 3. By way of example, for an aesthetic element 3 with a diameter of 1 mm, the distance between aesthetic element 3 and the edge of hollow 4 will be 0.45 mm.

In another example, the distance between aesthetic element 3 and the edge of hollow 4 is defined to comprise a "machined" area, i.e. an area in which the setting beads are made, this area being able to be hollow, and a "non-machined" area, which is an aesthetic visual area. In such case, the non-machined area will be at least 0.01 mm and at most 0.20 mm. It will preferably be 0.10 mm.

Likewise, it will be understood that the height of hole 8 is at least equal to the height of the culet of aesthetic element 3. This makes it possible, when aesthetic element 3 is set, to see as little as possible of the first material forming substrate 6. In that case, the setting beads 9, of which there are four, are made to have the shape of a right-angled triangle whose hypotenuse is convex. Preferably, the convex shape of the hypotenuse is similar to the curve of that of aesthetic element 3 when seen from above.

Figure 7:
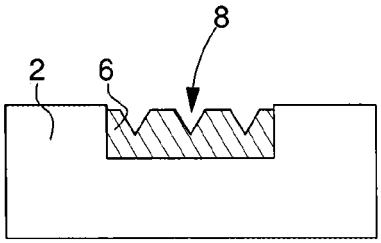

Once the fourth preparation step is finished, the support 2 seen in FIG. 7 is obtained, and the fifth setting step can then take place.

The conventional setting step consists of a deformation. This technique consists in placing aesthetic element 3 in hole 8 and in deforming the substrate and/or the setting elements 5 to press them onto said aesthetic element 3 as seen in FIGS. 9 to 13. Consequently, the latter is retained in setting hole 8.

The deformation may also be elastic or obtained by thermal expansion. In the case of elastic deformation, the setting is obtained by snap fitting the aesthetic element in gripping means 5. It is evident that in that case, a slight plastic deformation of gripping means 5 may occur. In the case of deformation by thermal expansion, the setting is obtained by heating support 2 to a sufficiently high temperature to allow the aesthetic element 3 to be inlaid it its hole 8 without force. Cooling will then allow the material to contract thus permitting retention of aesthetic element 3 by gripping means 5.

The method according to the invention therefore consists in:

a) taking a support made of a brittle material 2 with at least one hollow (4);

b) taking at least one aesthetic element 3;

c) filling said hollow with a first material;

d) making at least one setting hole 8 and at least one setting element in the first material;

e) setting said at least one aesthetic element by placing it in said at least one hole and plastically deforming the gripping means so as to retain it.

Unlike, crystalline materials, amorphous metals do not have lattice dislocations and cannot therefore be plastically deformed by the movement of the latter. They therefore generally exhibit brittle behaviour, i.e. they break suddenly once the elastic limit is exceeded. It has been observed, however, that some amorphous alloys can accommodate a permanent macroscopic deformation by generation of sliding strips on a microscopic scale. In addition to depending on the type of amorphous alloy, the capacity of amorphous metals to accommodate a permanent deformation greatly depends on the dimensions of the piece. Thus, the smaller the dimensions of the stressed area, the greater the permanent deformation will be able to be. For example, it is possible to permanently fold a strip with a thickness of 100 μm made of amorphous alloy Pt57.5Cu14.7Ni5.3P22.5 at an angle of more than 90° without breaking, whereas a strip of the same dimensions made of the amorphous alloy Fe56Co7Ni7Zr8Ta8B20 will not accommodate any permanent deformation Consequently, various setting methods have been devised.

A first setting method used is plastic deformation. The latter is achieved with a tool called a beading tool 100 used to deform each setting element 9, making it possible to obtain the set aesthetic element 3 of FIG. 13.

For amorphous alloys, plastic deformation is possible for amorphous alloys accommodating permanent deformation and having elastic limits that are not too high, typically less than 1500 MPa.

A second setting method is used for alloys have elastic limits that are too high for manual cold plastic deformation such as, for example, amorphous metal alloys having an elastic limit greater than 1500 MPa. The setting method consists in heating beads 9 to a temperature higher than the vitreous transition temperature Tg of the amorphous metal alloy in order to greatly reduce viscosity and thus the force necessary for deformation. The beads may be heated using a heated setting tool, by passing an electric current between the setting tool and the bead, by a laser beam focussed on the bead or any other method. Once beads 9 are at the right temperature, they are deformed so that setting can take place. Cooling to below the Tg then allows the beads to become solid again and thus make the setting effective. This solution has the advantage of allowing intimate contact between the amorphous metal alloy and aesthetic element 3 which improves the retention of the latter. In fact, in the case of cold plastic deformation, for both crystalline and amorphous metals, springback occurs during release of the force applied to bead 9. This springback inevitably involves a slight separation between bead 9 and aesthetic element 3, which may cause retention problems. The hot deformation used does not involve springback and there is therefore no release.

Figure 16:
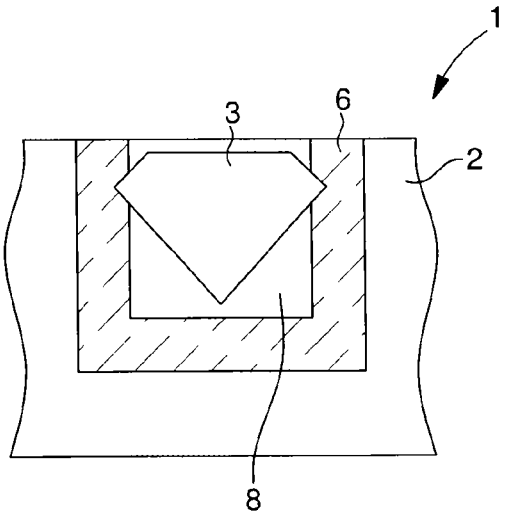

A third setting method is used when the alloys are difficult to set by cold or hot plastic deformation. This method consists of making use of the high elastic deformation of amorphous alloys, typically 2%, or that of crystalline alloys, typically 0.5%. The method consists in pressing aesthetic element 3 into setting hole 8 of substrate 6. Under pressure, the metal alloy of substrate 6 deforms elastically making it possible for aesthetic element 3 to be inserted. When gripping means 5 take the form of a setting recess, and the girdle or end or edge 3*a* of aesthetic elements 3 are opposite each other, springback occurs. The springback of gripping means 5 on aesthetic element 3 enables the latter to be permanently retained, as seen in FIGS. 15 and 16.

Figure 17:
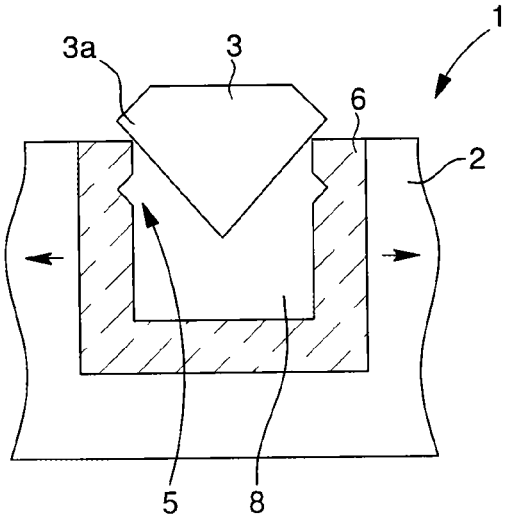
FIGS. 17 and 18 show another alternative of the method according to the invention.
Figure 18:
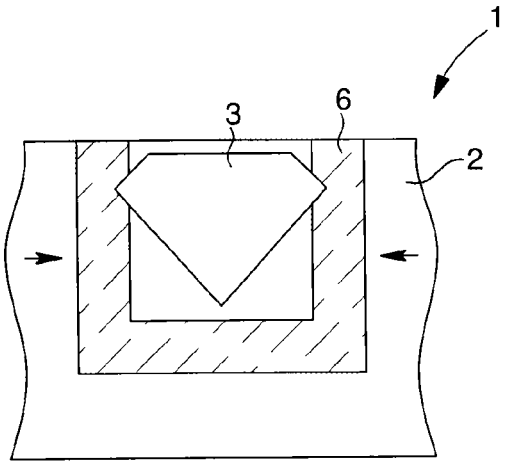

A fourth setting method is envisaged. In this method, support 2 is thermally heated so that the entire support expands, i.e. support 2 and substrate 6 made of amorphous alloy. Consequently, setting hole 8 also expands. Consequently, aesthetic element 3 can be placed in setting hole 8. Aesthetic element 3 is then retained in hole 8 by gripping means 5 after cooling of support 2 as seen in FIGS. 17 and 18. These gripping means 5 take the form of a setting recess in which the girdle or end or edge 3*a* of aesthetic element 3 is inserted.

A fifth setting method may also be envisaged specifically for amorphous metals in which the fourth step d) and fifth step e) are simultaneous. This method consists of heating the aesthetic element to a temperature greater than the vitreous transition temperature Tg of the first material and then pressing it into the latter, i.e. the amorphous metallic alloy. The heat released by said aesthetic element heats substrate 6 locally to a temperature greater than Tg which makes it possible to greatly reduce the viscosity of the amorphous metal alloy thereby facilitating insertion. Then, once the aesthetic element is inserted, substrate 6 is cooled to preserve the amorphous state of the alloy and is trimmed of any surplus material. This step thus permits improved retention of aesthetic element 3 in substrate 3 owing to the capacity of the amorphous metal alloy to mould well to the contours.

A sixth setting method is envisaged in which the third step c), fourth step d) and fifth step d) are simultaneous. This variant consists in providing that aesthetic element 3 is directly placed in hollow 4 before the step of filling said hollow 4 with the first material. The filling of hollow 4 is then accomplished by casting, by hot forming, by electroforming or by densification, the details of which were explained above. This technique makes it possible to have a faster setting method while ensuring good retention of aesthetic elements 3.

One advantage of the invention is that it makes it possible to set any type of material. Indeed, the principle used is the principle of an inserted piece, that is to say a substrate made of material capable of deformation is inserted in a non-plastically deformable material so as to permit setting and create the illusion that it is the non-plastically deformable material that is inset.

Figure 14:
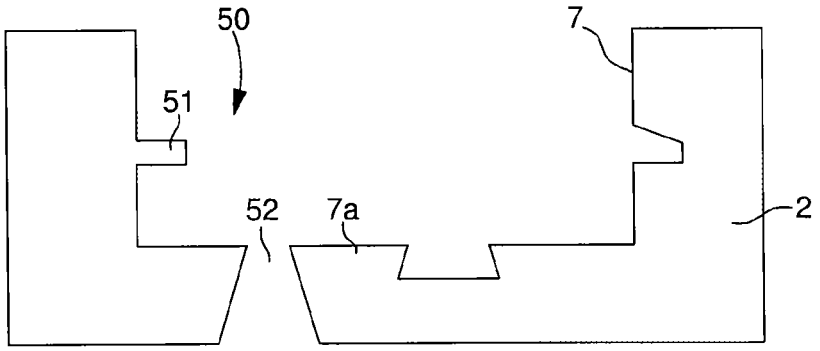
FIG. 14 shows a cross-sectional view of the retaining means according to the invention.

In a first variant seen in FIG. 14, retention of the first material is improved by the use of retaining means 50. These retaining means 50 include at least one recess 51 and/or at least one protuberance 52. Retaining means 50 are made prior to the filling of hollow 4. Consequently, during filling of said hollow, the first material fills recesses 5*a* or protuberances 5*b* are encased by said first material. As a result, when the first material fills hollow 4 and has solidified, it is perfectly retained in said hollow 4.

In the case where the first material is an amorphous metal alloy, the low viscosity of the amorphous material makes it possible to fill hollow 4 properly. By analogy, this low viscosity of the amorphous material also makes it possible to fill recesses 51 better or to better envelope protuberances 52.

These recesses 51 or protuberances 52 may be located on vertical flanks 7 of hollow 4 or on the bottom 7*a* of hollow 4. Likewise, recesses 51 may or may not be through recesses.

It will be clear that various alterations and/or improvements and/or combinations evident to those skilled in the art may be made to the various embodiments of the invention set out above without departing from the scope of the invention defined by the annexed claims.

The invention claimed is:

1. A decorative piece, comprising a support that is at least part of a timepiece component and that is made of a material that does not have a plastic deformation sufficient to permit setting an aesthetic element directly into the material of the support, and in which at least one hollow is arranged, the at least one hollow being a blind hole in the support, wherein said at least one hollow is filled with a first material forming a substrate in which at least one housing is arranged, said at least one housing is arranged so that the aesthetic element is housable therein, said first material is an amorphous metal alloy having an elastic limit greater than 1500 Mpa, said substrate further includes a gripper elastically deforming to retain said at least one aesthetic element in said at least one housing, said gripper further including at least one setting element that includes a bead which was heated to a temperature higher than a vitreous transition temperature of the amorphous metal alloy.

2. The decorative piece according to claim 1, wherein said at least one hollow includes vertical flanks to improve retention of each aesthetic element in the support.

3. The decorative piece according to claim 1, wherein said at least one hollow includes flanks arranged so that a surface of the hollow increases with a depth of the hollow.

4. The decorative piece according to claim 1, wherein said at least one hollow includes flanks arranged so that a surface of the hollow decreases with a depth of the hollow.

5. The decorative piece according to claim 1, wherein the first material includes at least one element which is of a precious type, comprised in the list including gold, platinum, palladium, rhenium, ruthenium, rhodium, silver, iridium or osmium.

6. The decorative piece according to claim 1, wherein a distance between the aesthetic element and one edge of the hollow is at least 0.01 mm.

7. The decorative piece according to claim 1, wherein a height of the housing is at least equal to a height of a culet of the aesthetic element.

8. A method of manufacturing a decorative piece, comprising providing a support that is at least part of a timepiece component and that is made of a material that does not have a plastic deformation sufficient to permit setting an aesthetic element directly into the material of the support, arranging at least one hollow in the support, the at least one hollow being a blind hole in the support, filling said at least one hollow with a first material forming a substrate in which at least one housing is arranged, said at least one housing being arranged so that the aesthetic element is housable therein, said first material is an amorphous metal alloy having an elastic limit greater than 1500 Mpa, and deforming a gripper of said substrate to retain said at least one aesthetic element in said at least one housing, said gripper further including at least one setting element, and said deforming includes heating a bead of the at least one setting element to a temperature higher than a vitreous transition temperature Tg of the amorphous metal alloy.

* * * * *